US009492944B2

(12) United States Patent
Ness

(10) Patent No.: US 9,492,944 B2
(45) Date of Patent: Nov. 15, 2016

(54) AGITATOR GRID WITH ADJUSTABLE RESTRICTOR ELEMENTS FOR CONCRETE BLOCK MACHINE

(71) Applicant: Ness Inventions, Inc., St. Paul, MN (US)

(72) Inventor: Jeffrey A. Ness, Oak Park Heights, MN (US)

(73) Assignee: Ness Inventions, Inc., St. Paul, MN (US)

( * ) Notice: Subject to any disclaimer, the term of this patent is extended or adjusted under 35 U.S.C. 154(b) by 2 days.

(21) Appl. No.: 14/553,257

(22) Filed: Nov. 25, 2014

(65) Prior Publication Data

US 2015/0147428 A1 May 28, 2015

Related U.S. Application Data

(60) Provisional application No. 61/908,490, filed on Nov. 25, 2013.

(51) Int. Cl.
*B28B 13/02* (2006.01)
*B28B 15/00* (2006.01)
*B30B 15/30* (2006.01)

(52) U.S. Cl.
CPC ..... *B28B 13/0235* (2013.01); *B28B 15/005* (2013.01); *B30B 15/304* (2013.01)

(58) Field of Classification Search
CPC ..... B28B 13/0235; B28B 15/005; B28B 15/304; B28B 15/30
See application file for complete search history.

(56) References Cited

U.S. PATENT DOCUMENTS

| | | | | |
|---|---|---|---|---|
| 2,593,409 | A | 4/1952 | Brown, Jr. | |
| 2,839,810 | A | 6/1958 | Kovach | |
| 2,859,502 | A | 11/1958 | Brown, Jr. | |
| 2,963,762 | A | 12/1960 | Kovach | |
| 3,343,239 | A * | 9/1967 | Davies | B28B 3/022 425/218 |
| 3,513,513 | A | 5/1970 | Estis | |
| 3,553,798 | A * | 1/1971 | Reckman et al. | B28B 3/022 425/123 |
| 3,604,075 | A * | 9/1971 | Locke | B28B 17/0081 340/309.8 |
| 5,059,110 | A * | 10/1991 | Allison | B28B 1/087 425/260 |
| 5,445,514 | A * | 8/1995 | Heitz | B28B 7/0097 249/114.1 |
| 8,327,833 | B2 | 12/2012 | Scherer et al. | |
| 2006/0182840 | A1 * | 8/2006 | High | B28B 1/081 425/432 |

(Continued)

*Primary Examiner* — Alison L Hindenlang
*Assistant Examiner* — Jerzi H Moreno Hernandez
(74) *Attorney, Agent, or Firm* — Dicke, Billig & Czaja, PLLC

(57) ABSTRACT

A feedbox for use in an automated dry-cast concrete block machine, including an agitator grid having a plurality of parallel agitator elements disposed parallel to a bottom of the feedbox, a plurality of prongs extending downward toward the bottom of the feedbox from each of the parallel agitator elements, and one or more restrictor elements slideably coupled with a coupling mechanism to one or more of the plurality of prongs which can be slideably adjusted along a length of the one or more prongs.

9 Claims, 8 Drawing Sheets

(56) References Cited

U.S. PATENT DOCUMENTS

2010/0007051 A1* 1/2010 Ness ..... B28B 13/0225
264/299
2010/0310695 A1* 12/2010 LaCroix ..... B28B 13/023
425/150

* cited by examiner

AGITATOR GRID WITH ADJUSTABLE RESTRICTOR ELEMENTS FOR CONCRETE BLOCK MACHINE

CROSS-REFERENCE TO RELATED APPLICATIONS

This Non-Provisional patent application claims benefit of U.S. Provisional Application No. 61/908,490, filed Nov. 25, 2013, entitled: AGITATOR GRID WITH ADJUSTABLE RESTRICTOR PLATES FOR CONCRETE BLOCK MACHINE, incorporated herein.

BACKGROUND

Concrete blocks, also referred to as concrete masonry units (CMU's), are typically manufactured by forming them into various shapes as part of an automated process employing an automated concrete block machine, such as those machines manufactured by Besser Company (Alpena, Mich.) and Columbia Machine, Inc. (Vancouver, Wash.), for example. Such machines typically employ a mold frame assembled so as to form a mold box, within which a mold cavity having a negative of a desired block shape is formed. To form a block, a pallet is moved by a conveyor system onto a pallet table, which is then moved upward until the pallet contacts and forms a bottom of the mold cavity.

A hopper is used to fill a feedbox assembly with a dry-cast concrete mixture. The feedbox assembly is then moved from a refracted or withdrawn position to an extended position over the mold frame and fills the mold cavity with concrete via the open top. A head shoe assembly is then moved into (descends) the top of the mold cavity and compresses the concrete (typically via hydraulic or mechanical means) to a desired psi rating (pounds-per-square-inch) while simultaneously vibrating the mold cavity along with the vibrating table.

As a result of the compression and vibration, the concrete reaches a level of "hardness" which enables the resulting finished block to be immediately removed from the mold cavity. To remove the finished block, the mold frame and mold cavity remain stationary while the shoe assembly, pallet, and pallet table move downward and force the finished block from the mold cavity. The conveyor system then moves the pallet bearing the finished block away and a clean pallet takes its place. This process is repeated for each block.

Feedbox assemblies typically employ agitator grids to assist in mixing and dispersing the dry cast concrete material in the feedbox so that it is evenly distributed into the mold cavity. Conventional agitator grids typically comprise a set of parallel bars that are joined by one or more cross-members, with prongs or fingers extending vertically downward form the parallel bars and into the concrete material in the feedbox. The agitator grid is then moved or vibrated so that the prongs or fingers agitate the dry cast concrete so as to better disperse the dry cast concrete material over and into the mold cavity.

In order to prevent dry cast concrete from being ejected from the feedbox and onto other parts of the concrete block machine and mold assembly while agitated, deflector or containment plates are sometimes attached to the top of the feedbox drawer. However, due to gaps between the plates, such plates blocking or deflector plates are not always effective at preventing concrete from being ejected from the feedbox during agitation.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
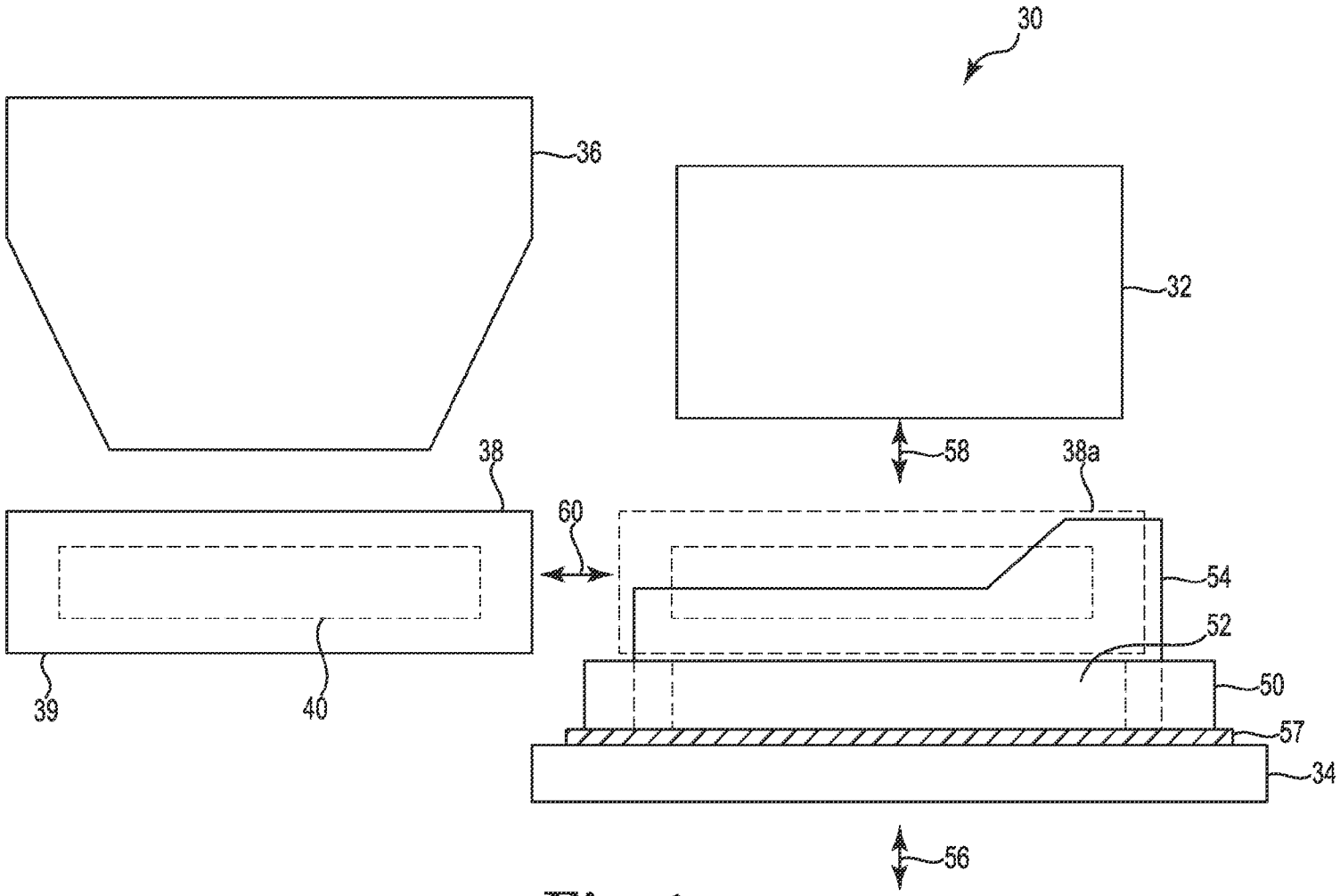
FIG. 1 is a block and schematic diagram generally illustrating an example of an automated concrete block machine employing a feedbox with an agitator grid having adjustable diverter elements according to the present disclosure.

FIG. 1 is a block and schematic diagram illustrating generally an example of an automated concrete block machine 30 employing a feedbox agitator grid having adjustable diversion elements, according to the present disclosure, for directing a dry-cast concrete mixture to desired locations within a mold in which one or more dry-cast concrete blocks are formed. An agitator grid, according to the present disclosure, can be adapted for use in any suitable automated concrete block machine, such as those manufactured by Besser Company (Alpena, Mich.) and Columbia Machine, Inc. (Vancouver, Wash.), for example.

Concrete block machine 30 includes a headshoe assembly 32, a table or pallet table 34, a hopper 36, in which a supply of a dry-cast concrete mixture is maintained, and a feedbox 38 (sometimes referred to as a drawer or feedbox drawer) having a bottom 39 and including an agitator grid 40, in accordance the present disclosure, which will be described in greater detail below. A mold assembly 50 defining one or more mold cavities 52, in which dry-cast concrete blocks are formed, is mounted to concrete block machine 30. In one embodiment, a top plate 54 is mounted to an upper side of mold assembly 50 which assists in confining dry-cast concrete mixtures to areas of mold assembly 50 and from spreading to other areas of the concrete block machine 30. Pallet table 34 moves vertically up/down, as indicated by directional arrows 56, to position a pallet 57 below an open bottom of mold assembly 50, and head shoe assembly 32 moves vertically up/down, as indicated by directional arrows 58, to compress a dry-cast concrete mixture within mold cavity 52. Feedbox 38 moves between a refracted position below hopper 36 and an extended position above mold assembly 50, as indicted by the dashed lines 38*a*, and by directional arrows During a block formation process, a pallet, such as pallet 57, is moved by a conveyor system (not shown) onto pallet table 34 which, in-turn, is moved upward until pallet 57 contacts and forms a bottom to mold cavity 52 (or mold cavities) formed by mold assembly 50. Feedbox 38 is positioned below hopper 36, which fills feedbox 38 with a desired amount of dry-cast concrete mixture. After being filled with a dry-cast concrete mixture, feedbox 38 is moved to extended position 38*a* (dashed lines in FIG. 1) above mold assembly 50 where it fills mold cavity, or cavities, 52 with the dry-cast concrete mixture as it moves and is position over the open top of mold cavities 52. Agitator grid 40 is moved/agitated to loosen the dry-cast concrete mixture within feedbox 38 so that the dry-cast concrete mixture is more easily transferred from feedbox 38 to mold cavities 52.

After the dry-cast concrete mixture has been emptied from feedbox 38 into mold cavity 52, feedbox 38 is returned to the retracted position below hopper 36. Concrete block machine 30 then moves head shoe assembly 32 down into the mold cavities 52 and compresses the dry-cast concrete mixture while simultaneously vibrating head shoe assembly 32, mold assembly 30, and pallet table 34 with pallet 57.

As a result of the compression and vibration, the dry-cast concrete within mold cavities 52 reaches a level of "hardness" which enables the resulting molded concrete blocks to be removed from therefrom. To remove the mold concrete blocks from the mold cavities 52, head shoe 32 and table 34, along with pallet 57, are moved downward until a top surface of molded concrete block is lower than the bottom of mold assembly 50, at which point the conveyor system moves the pallet 57 bearing the molded blocks to a curing oven. Simultaneously, the conveyor system positions a new pallet 57 on table 34, which raises the new pallet 57 to close the open bottom of mold assembly 50 and the above described process is repeated.

As described above, an agitator grid 40 is used to mix and loosen the dry-cast concrete mixture within feedbox 38 to assist in dispersing the dry-cast concrete mixture into the one or more mold cavities 52 of mold assembly 50. Conventional agitator grids typically comprise a set of parallel bars or rods which are joined by one or more cross-members to form an agitator framework, with a plurality of fingers or prongs extending downward from the parallel bars into the feedbox. The agitator grid is moved so as to agitate the dry-cast concrete mixture within feedbox 38 and assist in dispersing the mixture into mold cavities 52 as feedbox 38 moves over mold assembly 50.

Figure 2:
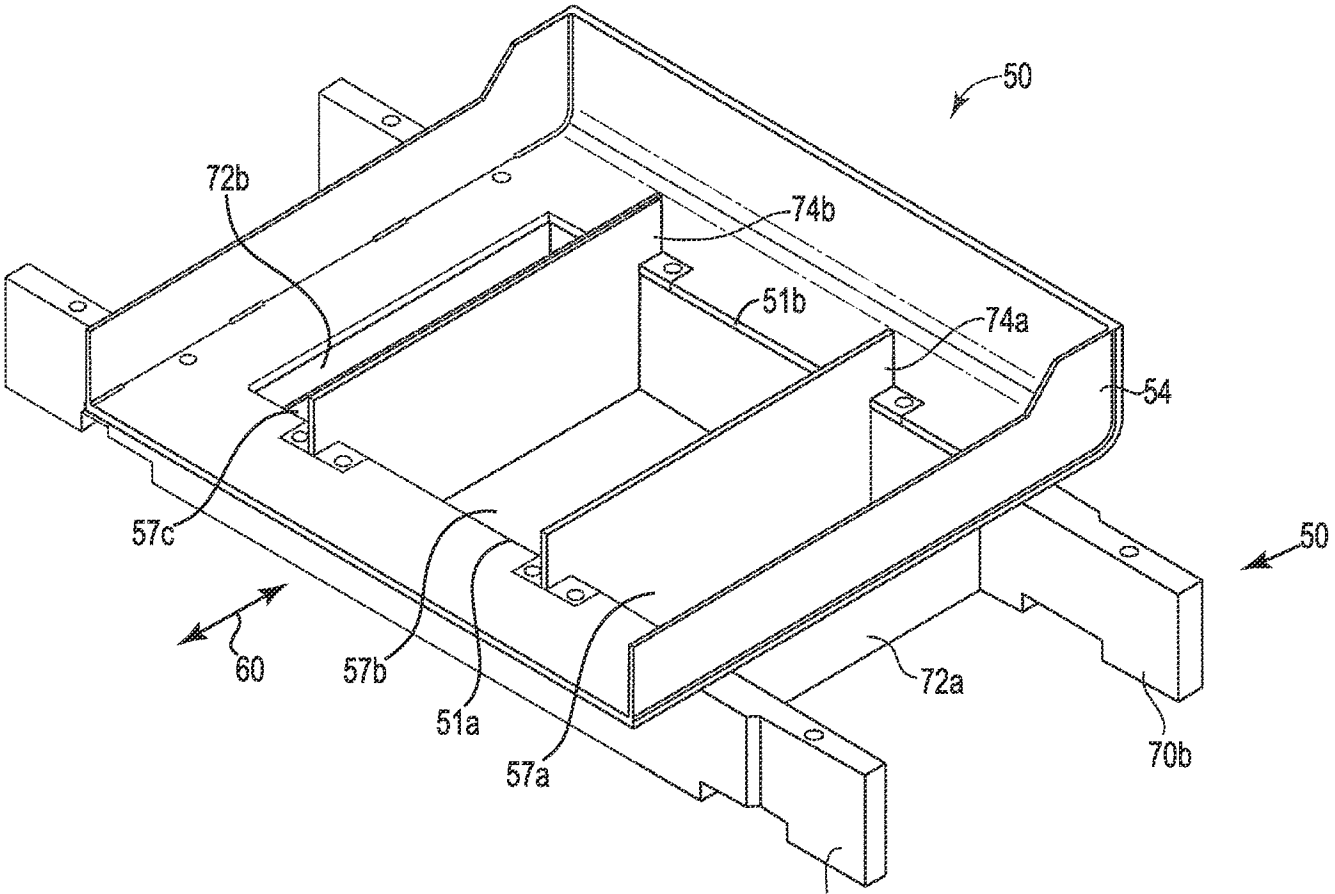
FIG. 2 is a perspective view illustrating portions of a mold assembly according to one example.

While such conventional agitator grids effectively assist in dispersing the dry-cast concrete mixture from feedbox 38, the dry-cast mixture is not always evenly distributed within the mold cavities 52. For example, FIG. 2 generally illustrates portions of one embodiment of mold assembly 50, along with top plate 54, which is suitable for use in concrete block machine 30 of FIG. 1. Mold assembly 50 includes a mold frame having side members 70*a*, 70*b* and cross-members 72*a*, 72*b* which are coupled to together to form mold cavity 52. According to the example of FIG. 2, division plates 74*a*, 74*b* are installed to divide mold cavity 52 into multiple mold cavities 52*a*, 52*b*, and 52*c*, with a concrete block being formed in each of the separate mold cavities.

As feedbox 38 passes over mold assembly 50 from a rear side 51*a* toward a front side 51*b* and empties the dry-cast concrete mixture into mold cavities 52*a*, 52*b*, and 52*c*, often, excess concrete is often deposited in central portions of the mold cavities 52*a*, 52*b*, and 52*c* while the front side 51*b* and corners of the mold cavity, particularly the corners along the front side 51*b* thereof, receive less concrete than is desired. Such uneven distribution of dry-cast concrete mixture within the mold cavities 52*a*-52*c* can lead to over and/or under compaction of the concrete mixture which, in-turn, can lead to defects in the molded concrete blocks, such as cracks or even portions of the blocks crumbling and falling away.

Such uneven distribution of concrete within mold cavity 52 can be particularly troublesome when a texture is formed on a surface of the block(s) formed in mold cavity 52, especially when the textures surfaces are formed along the front and rear sides 51*a*, 51*b* of mold cavity 52. Many types of CMUs (e.g. pavers, patio blocks, light-weight blocks, cinder blocks, etc.), retaining wall blocks and architectural units in particular, it is desirable for at least one surface of the block to have a desired texture, such as a stone-like texture, for instance. When arranged to form a structure with the textured surface visible, the structure will have the appearance of being constructed from natural stone, for example.

Figure 3:
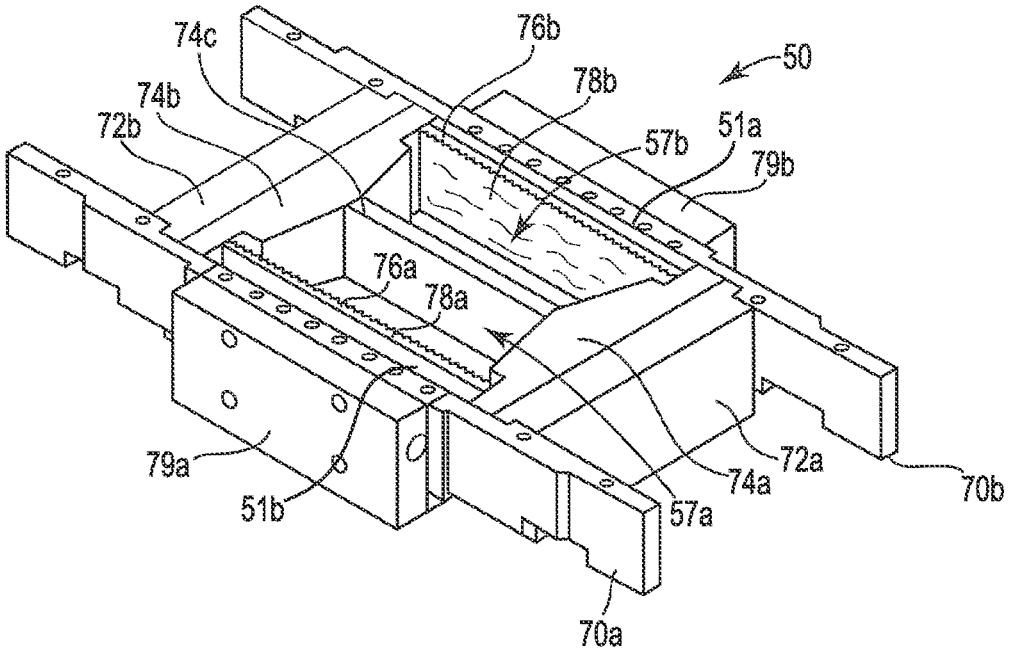
FIG. 3 is a perspective view illustrating portions of a mold assembly, according to one example, for molding concrete blocks having textured faces.

FIG. 3 generally illustrates one example of mold assembly 50 for molding concrete blocks with textured faces, such as retaining wall blocks, for instance. In addition to side-members 70*a*, 70*b* and cross-members 72*a*, 72*b*, mold assembly 50 includes stationary liner plates 74*a*, 74*b*, and 74*c*, and moveable liner plates 76*a*, 76*b* having textured faces 78*a*, 78*b* which together form a pair of mold cavities 52*a*, 52*b*. A pair of drive assemblies 79*a*, 79*b* are coupled to and drive moveable liner plates 76*a*, 76*b* back and forth within mold cavities 52*a*, 52*b*, with texture faces 78*a*, 78*b* being negatives of a desired texture or pattern to be imparted to a face of the blocks formed in mold cavities 52*a*, 52*b*. Examples of drive assemblies suitable for use as drive assemblies 79*a*, 79*b* are described by U.S. Pat. Nos. 7,156,645 and 7,261,548 which are assigned to the same assignee as the present disclosure.

In operation, moveable liner plates 76*a*, 76*b* are moved from a retracted position to a desired extended position by drive assemblies 79*a*, 79*b* and mold cavities 52*a*, 52*b* are filled with dry-cast concrete via feedbox 38. Head shoe assembly 32 then compresses the concrete within mold cavities 52*a*, 52*b* while mold assembly 50 is vibrated to form pre-cured concrete block therein. The moveable liner plates 76*a*, 76*b* are then moved to a retracted position and the pre-cured concrete blocks, having textured surfaces formed by textured faces 78*a*, 78*b*, are removed form mold cavities 52*a*, 52*b* through action of head shoe assembly 32 and table 34 and pallet 57 and sent to a curing oven, as described above.

While such techniques are effective at forming textured surfaces on the faces of the resulting pre-cast concrete blocks, air pockets trapped between the textured faces 78*a*, 78*b* of the moveable liner plates 76*a*, 76*b* and the dry-cast concrete mixture within mold cavities 52*a*, 52*b* are forced out during the compression/vibration process. As the air pockets are forced out, the dry-cast concrete mixture settles proximate to the textured faces 78*a*, 78*b* and causes the finally finished concrete block to a height along the textured surface (e.g. front face of block) which is shorter than that along an opposite surface (e.g. rear face of block). The settling and resulting differences in height between the opposing surfaces of the block is exacerbated by the uneven distribution of dry-cast concrete mixture deposited within mold cavities 52*a*, 52*b* by feedbox 38, especially when the moveable liner plates 76*a*, 76*b* and corresponding textured faces 78*a*, 78*b* are positioned on the front and rear sides 51*a*, 51*b* of mold assembly 50, as illustrated by FIG. 3.

Figure 4:
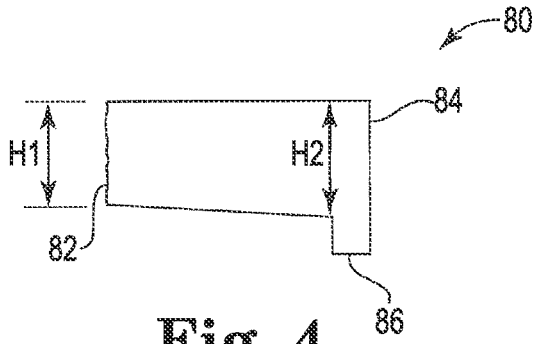
FIG. 4 is a side view illustrating an example of a retaining wall block having a textured surface.

FIG. 4 is a side view illustrating an example of a retaining wall block 80 formed in mold 50 using a conventional agitator grid as described above by FIG. 3. Retaining wall block 80 includes a front face 82, rear face 84, and a set-back flange 86 extending from the bottom of the block along rear face 84. As illustrated, because of insufficient amounts of concrete being disposed in mold cavities 52*a*, 52*b* along textured faces 78*a*, 78*b* of moveable liner plates 76*a*, 76*b*, and because of air trapped between the textured faces 78*a*, 78*b* being removed during compaction and vibration, the dry-cast concrete mixture is compressed and settles such that a height H1 of textured front face 82 of retaining wall block 80 is less than a height H2 along rear face 84 adjacent to set-back flange 86.

Figure 5:
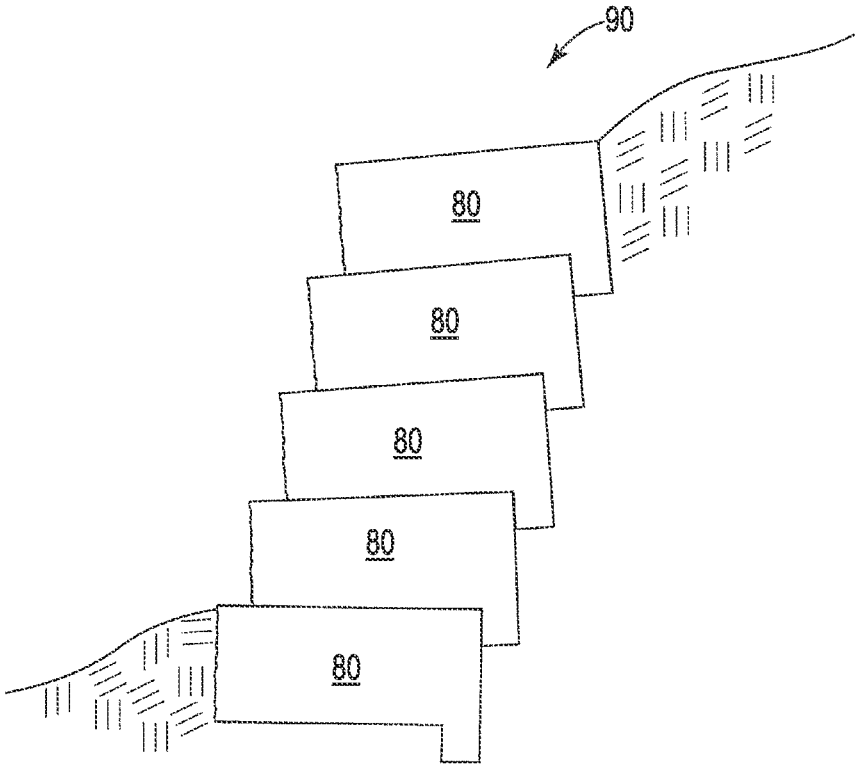
FIG. 5 illustrates an example of a wall structure formed by the retaining wall block of FIG. 4.

As a result, as illustrated by FIG. 5, when stacked to form a soil retention wall 90, as illustrated by FIG. 7B, each course of blocks is tilted downward from horizontal such that soil retention wall 90 leans further downward from horizontal with each successive course of blocks causing soil retention wall 90 to have a forward lean. Such a forward lean may cause soil retention wall 90, or other structures formed using masonry blocks 80, to become unstable.

In attempts eliminate problems associated with the uneven distribution of concrete within mold cavity 52, deflector elements are sometimes affixed (such as by welding) to various locations on the upper surfaces of the framework of agitator grid 40, opposite the prongs extending downward into the feedbox 38. The deflector elements are intended to lessen the amount of dry-cast concrete mixture deposited in areas of mold cavity 52 that tend to receive too much concrete and to direct more dry-cast concrete to areas of mold cavity 52 that tend to receive too little concrete, and thereby even out the level of dry-cast concrete throughout mold cavity 50. However, because of their height relative to feedbox 38, such metal elements tend to be ineffective at evenly distributing dry-cast concrete within mold cavity 52 and often result in concrete being ejected from feedbox 38 during agitation of agitator grid 40. Such metal elements are also very difficult, if not impossible, to adjust.

Figure 6:
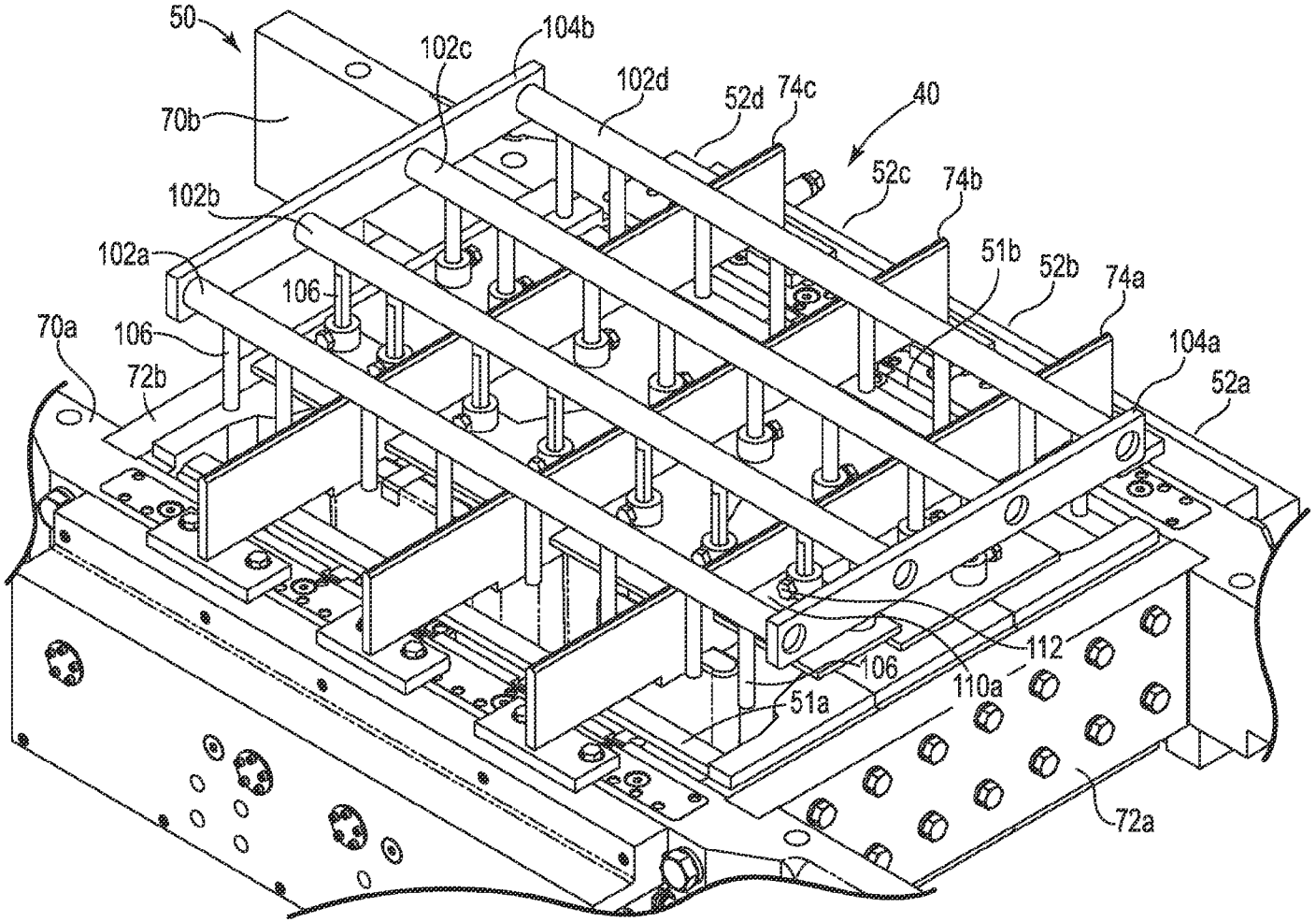
FIG. 6 is a perspective view illustrating portions of a mold assembly and agitator grid according to one embodiment.

FIG. 6 is a perspective view illustrating portions of a mold assembly 30 and agitator grid assembly 40 according to one embodiment of the present disclosure. It is noted that feedbox 38 is not shown in FIG. 6 so as to more clearly illustrate agitator grid assembly 40. According to the embodiment of FIG. 6, mold assembly 30 includes a set of three division plates 74*a*, 74*b*, and 74*c* which divides the mold cavity in four mold cavities 52*a*, 52*b*, 52*c*, and 52*d* (see also FIGS. 7 and 8).

According to the embodiment of FIG. 6, agitator grid 40 includes a set of four parallel rods or bars 102*a*, 102*b*, 102*c*, and 102*d* (also referred to herein as agitator bars or agitator elements) which extend horizontally above and across division plates 74*a*, 74*b*, and 74*c*, and which are joined together by a pair of crossbars 104*a*, 104*b*, and which together form a grid-like frame. A plurality of fingers or prongs 106 extend downwardly from each of the parallel bars 102*a*-102*d* (and into a dry-cast concrete mixture when such mixture is present in feedbox 40). According to the example of FIG. 6, two prongs 106 extend from each of the parallel bars 102*a*-102*d* between each of the mold division plates and correspond to each of the mold cavities 52*a*-52*d*. A plurality of restrictor or diverter elements or plates are moveably coupled to prongs 106 by a coupling mechanism, such as restrictor plate 110*a* coupled to prongs 106 of parallel bar 102*b* corresponding to mold cavity 52*a* using set-screw collars 112.

Figure 7:
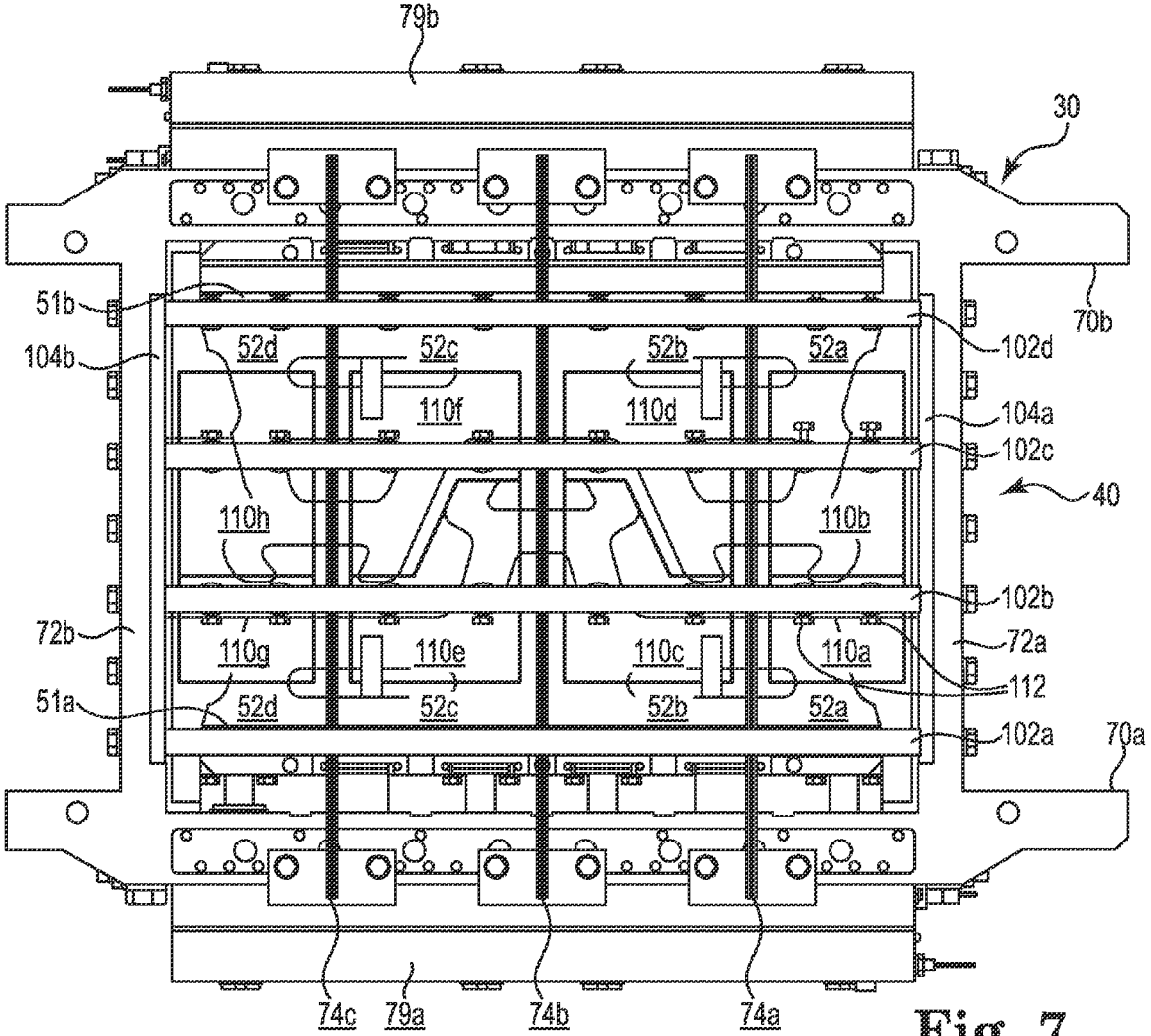
FIG. 7 is a top view illustrating portions of the mold assembly and agitator grid of FIG. 6, according to one embodiment.

FIG. 7 is a top view of mold assembly 50 and agitator grid 40 of FIG. 6 which more clearly illustrates the restrictor plates 110 of agitator grid 40. According to the illustrated example, each of the central parallel bars 102*b*, 102*c* has four restrictor plates 100 attached to a pair of prongs 106 thereof with each diverter plate corresponding to a different one of the mold cavities 52*a*-52*d*. Restrictor plates 110*a*, 110*c*, 110*e*, and 110*g* are coupled to corresponding prongs 106 of parallel bar 102*b* and respectively correspond to mold cavities 52*a*, 52*d*, 52*c*, and 52*d*, and restrictor plates 110*b*, 110*d*, 110*f*, and 110*h* are coupled to corresponding prongs 106 of parallel bar 102*c* and respectively correspond to mold cavities 52*a*, 52*d*, 52*c*, and 52*d*.

As more clearly illustrated in FIG. 7, restrictor plates 110*a* and 110*g* are rectangular in shape, restrictor plates 110*b* and 110*h* are also rectangular in shape, but are larger in area than restrictor plates 110*a* and 110*g*, while restrictor plates 110*c*, 110*d*, 110*e*, and 110*f* are non-rectangular shape. It is noted that the restrictor plates 110 can be of any number of different shapes and/or sizes.

Figure 8:
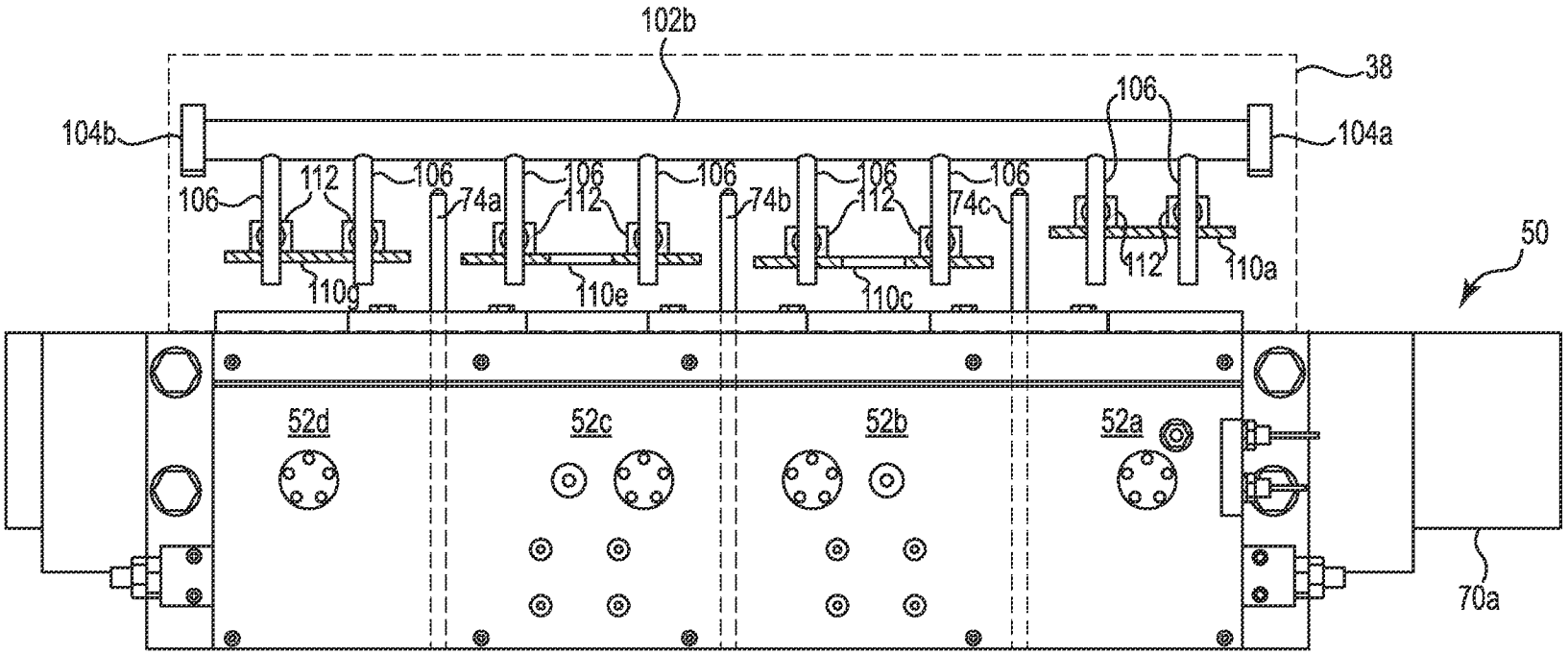
FIG. 8 is a side view illustrating portions of the mold assembly and agitator grid of FIG. 6, according to one embodiment.

FIG. 8 is a side view of mold assembly 50 more clearly illustrating parallel bar 102*b* of agitator grid 40. As illustrated, restrictor plates 110*a*, 110*c*, 110*e*, and 110*g* are each moveably coupled by a pair of set-screw collars 112 to a corresponding pair of prongs 106 extending downwardly from bar 102 toward an open top of mold 50. As illustrated, prongs 106 extend through set-screw collars 112 which connected to restrictor plates 110, such as by welding, for example.

According to one embodiment, the position of restrictor plates 110 and collars 112 is vertically adjustable along a length of prongs 106 by sliding collars 112 and plates 110 thereon. According to one embodiment, restrictor plates 110 are held at a desired position along prongs 106 by a retaining mechanism, such as a set-screw in collar 112. It is noted that any suitable retaining mechanism other than a collar and set-screw arrangement can also be employed to adjustably secure diverter plates 110 to prongs 106. According to one embodiment, as illustrated by FIG. 8, coupling restrictor plates 110 to at least a pair of prongs 106 more securely couples restrictor plates 110 to agitator grid 40 and prevents rotation of restrictor plates 110 during agitation. However, it is noted that in other embodiments, restrictor plates 110 may be coupled to more than two or less than two (i.e. one) prongs 106. For example, if coupled to only a single prong 106, prongs 106 may be rectangular in shape so as to prevent rotation of restrictor plates 110.

According to one embodiment, as illustrated by FIG. 8, the vertical position or vertical height of each restrictor plate 110 can be independently adjusted so that up to all of the restrictor plates 110 can be set at different heights. For example, in FIG. 8, restrictor plate 110*a* is positioned so as to be set a height which is greater than that of restrictor plates 110*c*, 110*e*, and 110*g*. Adjusting the vertical height of restrictor plates 110 enables better control over the volume of concrete disposed into corresponding areas of the corresponding mold cavity. The higher the restrictor plate 110 is positioned on prong 106 (i.e. closer to parallel bars 102), the bigger the gap between restrictor plate 110 and the top of mold cavities 57 and the more dry-cast concrete will be able to flow into mold cavity 57 at that location. Conversely, the lower restrictor plate 110 is positioned on prong 106 (i.e. further away from parallel bars 102), the smaller the gap between restrictor plate 110 and the top of mold cavity 57 and the less dry-cast concrete will be able to flow from feedbox 38 into mold cavity 57 at that location. For example, in FIG. 8, restrictor plate 110*a* allows more dry-cast concrete to be disposed in the corresponding portion of mold cavity 52*a* that is allowed by restrictor plates 110*c*, 110*e*, and 110*g* into the corresponding portions of mold cavities 52*b*, 52*c*, and 52*d*.

Figure 9:
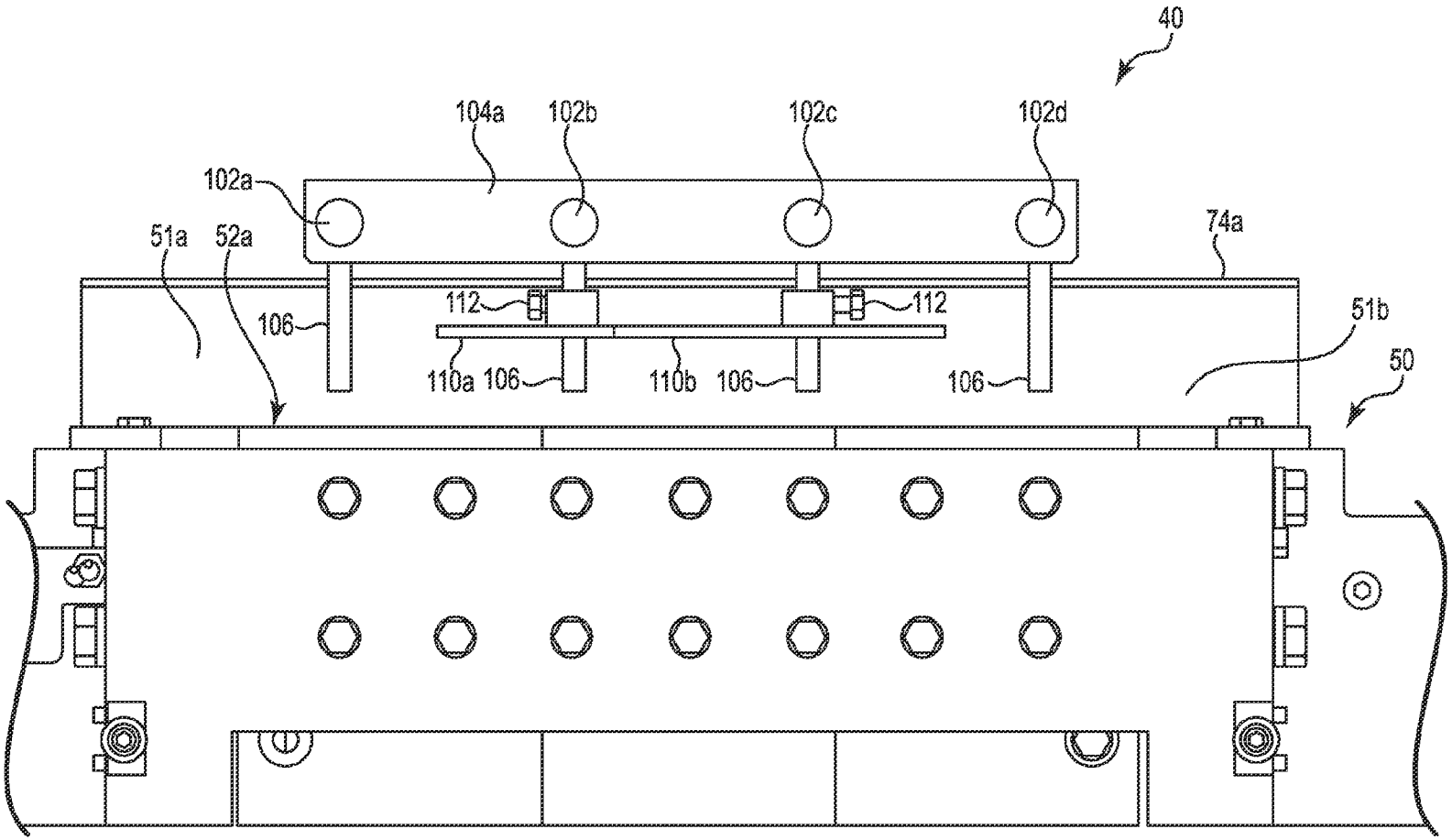
FIG. 9 is an end view illustrating portions of the mold assembly and agitator grid of FIG. 6, according to one embodiment.

FIG. 9 is an end view illustrating portions of mold assembly 50 and agitator grid 40. FIG. 9 illustrates prongs 106 extending downward from parallel bars 102*a*, 102*b*, 102*c*, and 102*d* and corresponding to mold cavity 52*a*, with restrictor plate 110*a* being coupled to prongs 106 of bar 102*b* and restrictor plate 110*b* being coupled to prongs 106 of bar 102*c*. Note that the no restrictor plates on the prongs of bars 102*a* and 102*d*. Also note that, according to the illustrated embodiment, restrictor plates 110*a* and 110*b* are positioned at a same height on prongs 106, which is at a height higher than that at which restrictor plates 110*c*-110*g* are positioned. Additionally, according to the configuration as illustrated by FIGS. 6-9, restrictor plates 110*a*-110*h* are positioned so that more of the dry-cast concrete mixture from feedbox 40 is directed to the front side 51*b* of mold 50 in each of the cavities 52*a*-52*d* and to middle and fronts side 51*a* of cavity 52*a* than to the middles and front sides 51*a* of cavities 52*b*, 52*c*, and 52*d*.

In contrast to conventional techniques of fixedly attaching diverter elements to the upper surface of feedbox 40, agitator grid 40 according to the present disclosure employs restrictor plates 110 that can be individually and readily adjusted along the length of prongs 106 via set-screw collars 112 (or any suitable adjusting mechanism) so as easily control, fine-tune, and provide desired amounts of concrete to different parts of the mold cavity or cavities 52 within mold assembly 50. By distributing volumes of dry-cast concrete to desired locations with mold cavity or mold cavities 50, more even compression of the dry-cast concrete within mold cavities 50 by head shoe assembly 32 is obtained, thereby reducing or eliminating problems associated with over and under compression (e.g. cracking, crumbling of the dry cast concrete blocks). Also, by directing more concrete to areas of the mold cavities where textures are imparted to the block faces (see FIGS. 3-5), agitator grid 40 employing adjustable restrictor plates 110 can reduce or eliminate the tapering in heights of such blocks, as described above.

Additionally, restrictor plates 110, according to the present disclosure, are fully adjustable and customizable to meet different mold cavity shapes and can be readily employed on existing concrete block machines without requiring any additional or custom components. Instead, restrictor plates 110 can be adapted to be readily installed on the agitator grids of conventional concrete block machines without the need for additional components. Additionally, the restrictor plates 110 of agitator gird 40 can be used in conjunction with or as a replacement for controllable cutoff bars, which are also employed to adjust/vary the volume of concrete deposited in mold cavities, but which can require more complicated installation and operation (e.g. more moving parts) than restrictor plates 110 of agitator grid 40 of the present disclosure.

Although defined above as having a set of four parallel bars 102*a*-102*d* and eight restrictor plates 110*a*-110*h*, and being employed with a mold assembly 50 having four mold cavities 52*a*-52*d*, it is noted that agitator grid 40 according to the present disclosure can employ any number of bars 102, prongs 106, and restrictor plates 110, and be used with molds having any number of mold cavities.

Additionally, although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A feedbox for a dry-cast concrete block machine, the feedbox comprising:

an agitator grid positioned within the feedbox and having a plurality of agitator elements disposed parallel to a bottom of the feedbox;

a plurality of prongs extending perpendicularly from the plurality of agitator elements downward toward the bottom of the feedbox; and one or more restrictor elements slideably coupled with a coupling mechanism to one or more of the plurality of prongs which can be slideably adjusted along a length of the one or more prongs, each restrictor element having a major surface extending perpendicularly to the prongs so as to be parallel to the bottom of the feedbox, the restrictor elements configured to adjust a volume of concrete disposed from corresponding areas of the feedbox.

2. The feedbox of claim 1, wherein the coupling mechanism comprises a collar and set-screw, wherein the prong is slideably received by the collar and the restrictor element is secured to the prong with the set-screw.

3. The feedbox of claim 1, wherein each restrictor element is coupled to at least two prongs of an agitator element to eliminate rotational movement about the prongs.

4. An agitator grid for a feedbox drawer of a dry-cast concrete block machine, the agitator grid comprising:

a framework of elements including one or more agitator bars;

a plurality of prongs extending perpendicularly in a same direction from each of the one or more agitator bars toward a bottom of the feedbox drawer when disposed therein; and one or more restrictor elements adjustably coupled with a coupling mechanism to one or more prongs of one or more of the agitator bars, wherein the restrictor elements can be slideably adjusted along a length of the one or more prongs, each restrictor element having a major surface extending perpendicularly to the prongs so as to be parallel to the bottom of the feedbox when disposed therein, the restrictor elements configured to adjust a volume of concrete disposed from corresponding areas of the feedbox.

5. The agitator grid of claim 4, wherein the coupling mechanism comprises a collar and set-screw, wherein the prong is slideably received by the collar and the restrictor element is secured to the prong with the set-screw.

6. The feedbox of claim 4, wherein each restrictor element is coupled to at least two prongs of an agitator bar to eliminate rotational movement about the prongs.

7. An automated dry-cast concrete block machine including:

a feedbox for transporting dry-cast concrete between a hopper and a mold assembly, the feedbox including an agitator grid including:

a plurality of agitator bars disposed within and parallel to a bottom of the feedbox;

a plurality of prongs extending perpendicularly downward from each of the agitator bars toward the bottom of the feedbox; and one or more restrictor elements adjustably coupled with a coupling mechanism to one or more prongs of one or more of the agitator bars, wherein the restrictor elements can be slideably adjusted along a length of the one or more prongs, each restrictor element having a major surface extending perpendicularly to the prongs so as to be parallel to the bottom of the feedbox, the restrictor elements configured to adjust a volume of concrete disposed from corresponding areas of the feedbox.

8. The automated dry-cast concrete block machine of claim 7, wherein the coupling mechanism comprises a collar and set-screw, wherein the prong is slideably received by the collar and the restrictor element is secured to the prong with the set-screw.

9. The automated dry-cast concrete block machine of claim 7, wherein each restrictor element is coupled to at least two prongs of an agitator bar to eliminate rotational movement about the prongs.

* * * * *